US006123741A

United States Patent [19]

Girbaud et al.

[11] Patent Number: 6,123,741

[45] Date of Patent: Sep. 26, 2000

[54] PROCESS FOR DYEING A TEXTILE MATERIAL WITH INDIGO AND ARRANGEMENT FOR CONDUCTING THE PROCESS

[76] Inventors: Francois Girbaud; Marie-Thérése Bachellerie, both of 2 Ennismore Gardens, London SW7 1NL, United Kingdom

[21] Appl. No.: 09/334,549

[22] Filed: Jun. 16, 1999

Related U.S. Application Data

[62] Division of application No. 09/113,590, Jul. 10, 1998, abandoned.

[30] Foreign Application Priority Data

Feb. 26, 1998 [EP] European Pat. Off. ..... 98630005

[51] Int. Cl.[7] ..... D06P 5/02; D06P 1/22; D06P 5/08; D06F 31/00

[52] U.S. Cl. ..... 8/495; 8/653; 8/931; 8/932; 8/918; 8/116.5; 8/151.2; 68/9; 68/22 R

[58] Field of Search ..... 8/495, 653, 931, 8/918, 116.5, 151.2, 932, 68

[56] References Cited

U.S. PATENT DOCUMENTS

| | | | |
|---|---|---|---|
| 1,500,298 | 7/1924 | Chase et al. | 68/9 |
| 2,110,595 | 3/1938 | Foss | 8/151.2 |
| 2,402,653 | 6/1946 | Clark | 68/9 |
| 2,920,932 | 1/1960 | Barnhill . | |
| 3,457,022 | 7/1969 | Fields . | |
| 3,681,824 | 8/1972 | Yasuji . | |
| 3,800,565 | 4/1974 | Worth et al. . | |
| 4,118,183 | 10/1978 | Godau et al. . | |
| 4,231,744 | 11/1980 | Moot . | |
| 4,283,198 | 8/1981 | Fletcher . | |
| 4,313,235 | 2/1982 | Gotovtseva et al. . | |
| 4,335,185 | 6/1982 | Adelman et al. . | |
| 4,416,124 | 11/1983 | Godau . | |
| 4,448,839 | 5/1984 | Morris . | |
| 4,501,589 | 2/1985 | Oschatz . | |
| 5,134,789 | 8/1992 | Godau et al. . | |
| 5,350,530 | 9/1994 | Kim et al. . | |
| 5,397,483 | 3/1995 | Porter et al. . | |
| 5,586,992 | 12/1996 | Schnitzer et al. . | |

FOREIGN PATENT DOCUMENTS

| | | | |
|---|---|---|---|
| 1098258 | 3/1981 | Canada | 68/9 |
| 0246933 | 11/1987 | European Pat. Off. . | |
| 0692042 | 11/1996 | European Pat. Off. . | |
| 2544613 | 4/1977 | Germany . | |
| 4007504 | 9/1990 | Germany . | |
| 4223556 | 1/1994 | Germany . | |
| 614339 | 11/1979 | Switzerland . | |

*Primary Examiner*—Margaret Einsmann
*Attorney, Agent, or Firm*—Polster, Lieder, Woodruff & Lucchesi

[57] ABSTRACT

The invention relates to a process for dyeing a thread with indigo, characterized in that it comprises the following steps:

a. prewashing a thread F by passing it through a prewash arrangement (1) comprising two or more tanks (2) containing a prewash solution (10, 15);

b. then dyeing the thread by passing it through a dyeing arrangement (30) comprising a series of tanks (35) each containing a solution of reduced indigo, and when passing from one tank (35) to another, the thread is subjected to oxidation by exposure to the air transforming the reduced indigo into indigo, which then dyes the thread by impregnation, the oxidation by exposure to the air being achieved in such a way that when passing from the first tank (35) to the eighth in succession, if the value x is given to the oxidation between the first and second tanks, the result will be:
After the 8th tank the oxidation value=8x;

c. washing and initial drying the thread by passing it through a washing and initial drying arrangement (40).

d. sizing the dyeing of the indigo on the thread by passing it through a sizing arrangement (60) comprising a tank (62) containing a mixture of resins to form a transparent film on the fibers of the thread;

e. drying the thread by passing it through a drying arrangement (70) comprising rollers (71); and f. collecting the warp thread by rolling it on a drum (72).

17 Claims, 4 Drawing Sheets

PROCESS FOR DYEING A TEXTILE MATERIAL WITH INDIGO AND ARRANGEMENT FOR CONDUCTING THE PROCESS

CROSS-REFERENCE TO RELATED APPLICATIONS

This application is a divisional of Ser. No. 09/113,590 filed Jul. 10, 1998, now abandoned.

STATEMENT REGARDING FEDERALLY SPONSORED RESEARCH OR DEVELOPMENT

Not Applicable

BACKGROUND OF THE INVENTION

The present invention relates to a process for dyeing a textile material with indigo and an arrangement for conducting the process.

By means of this process a textile thread dyed with indigo is produced which subsequently allows a fabric named denim fabric to be prepared with which items such as jeans etc. are made.

Indigo is one of the oldest known dyes and has been used for centuries to dye textiles such as cotton.

European patent 692,042 describes a process for dyeing a textile fabric containing cellulose with indigo, in which an aqueous solution of leuco-indigo prepared by catalytic hydrogenation is used, the latter being converted into pigment form by oxidation in air after being applied on the textile fabric.

U.S. Pat. No. 4,283,198 describes a continuous process for dyeing cellulose fibers with indigo, wherein the fibers are passed through a series of soaking tanks containing a liquor of leuco-indigo, sodium hydrosulphite and sodium hydroxide.

U.S. Pat. No. 3,457,022 describes a process of dyeing cotton fibers with indigo, in which the indigo is applied at a temperature of between 65° C. and 80° C. to the threads and the indigo is then applied at temperatures below 40 C.

Denim dyed with indigo has the disadvantage that it fades with washing. In recent years it has even been the fashion to wear faded jeans and the industry has developed processes and equipment to follow this fashion, in which fading of the fabric was accentuated and promoted by enabling the warp thread to fade. The method used for the dyeing facilitates fading and aging. However, every fashion is short-lived and only lasts for a time.

BRIEF SUMMARY OF THE INVENTION

The aim of the present invention is to produce a fabric resistant to wear and fading upon washing, and with the fabric according to the invention neither the washing water used nor the corrosive detergents used in washing are of primary concern.

The process is a five step process and includes initially prewashing a thread by passing it through a prewash arrangement comprising two or more tanks containing a prewash solution. The prewash solution contains a derivative of fatty alkyl phosphate ester, such as FINBIL AS.

The thread is then dyed by passing it through a dyeing arrangement comprising a series of dyeing tanks each containing a solution of reduced indigo. The dyeing bath in the dyeing tanks contains a solution of reduced indigo containing 3 to 5% of powdered indigo, a corresponding quantity of sodium hydrosulphite amounting to ⅔ of the quantity of indigo and a corresponding quantity of caustic soda 36 Baumé amounting to double the quantity of indigo. When the thread is passing from one dyeing tank to another the thread is subjected to oxidation by exposure to the air transforming the reduced indigo into indigo, which then dyes the thread by impregnation. The oxidation of the indigo by exposure to the air is achieved in such a way that when passing from the first dyeing tank to the eighth in succession, if the value x is given to the oxidation between the first and second dyeing tanks, the successive result will be:

Between the 1st and 2nd tanks the oxidation value=x

Between the 2nd and 3rd tanks the oxidation value=2x

Between the 3rd and 4th tanks the oxidation value=3x

Between the 4th and 5th tanks the oxidation value=4x

Between the 5th and 6th tanks the oxidation value=5x

Between the 6th and 7th tanks the oxidation value=6x

Between the 7th and 8th tanks the oxidation value=7x

After the 8th tank the oxidation value=8x;

The dyeing step may be repeated several times using 8x dyeing tanks, where x is an integer and has a value equal to or greater than 1. Preferably, the threads pass through the dyeing baths at a speed of 20 to 60 m/minute.

After dyeing, the thread is washed and dried by passing it through a washing and initial drying arrangement comprising a series of washing tanks. The first washing tank contains water, three middle washing tanks contain acetic acid; and the last washing tank contains water such that the pH in the last tank will be between 6 and 7. The acetic acid solution in a first middle washing tank is obtained by adding 50% acetic acid to the tank in a quantity of 20 cc/l; the acetic acid solution in a second middle washing tank is obtained by adding 50% acetic acid to the tank in a quantity of 10 cc/l; and the acetic acid solution in a third middle washing tank is obtained by adding 50% acetic acid to the tank in a quantity of 5 cc/l.

Upon exit from the last washing tank, the thread is pre-dried by passing it between drying rollers.

The thread is then sized by passing it through a sizing arrangement comprising a sizing tank containing a mixture of resins to form a transparent film on the fibers of the thread. The composition of the mixture of resins comprises a mixture of:

10 to 50 g/l of quaternary salts of polyalkylamine;

10 to 50 g/l of fluorocarbon resin;

10 to 200 g/l of acrylic resin;

1 to 20 g/l of autocatalysed polysiloxane; and 10 to 200 g/l of polyurethane resin.

The thread is then dried by passing it through a drying arrangement comprising drying rollers. Lastly, the warp thread is collected by rolling it on a drum.

The prewash arrangement comprises two or more prewash tanks containing a prewash solution, a first guide roller to direct the thread into the prewash solution, a second guide roller to direct the thread between two pressing rollers which guides the thread towards a third guide roller, two pressing rollers to remove the excess of liquid, a fourth guide roller directing the thread into the washing liquid of a second washing tank, a fifth guide roller directing the thread towards two pressing rollers, a sixth guide roller directing the thread once again into the prewash liquid of the second prewash tank and two pressing rollers to initially drying the thread upon exit from the second prewash tank.

The dyeing arrangement comprises a series of eight dyeing tanks containing a bath of reduced indigo, a series of rollers associated with each dyeing tank, the rollers being disposed between each dyeing tank in such a manner that there is one roller between the first and second dyeing tanks, two rollers between the second and third dyeing tanks, three rollers between the third and fourth dyeing tanks and so on and so on until the eighth dyeing tank, where there are eight rollers, thus enabling the time of exposure to the open air to be progressively increased.

It is known that indigo is practically insoluble in water and cannot therefore be used as such for dyeing. It must firstly be used in a soluble form and then the dye is generated in an insoluble form in the fiber or thread.

For fixing the indigo, leuco-indigo is oxidized according to the following reaction:

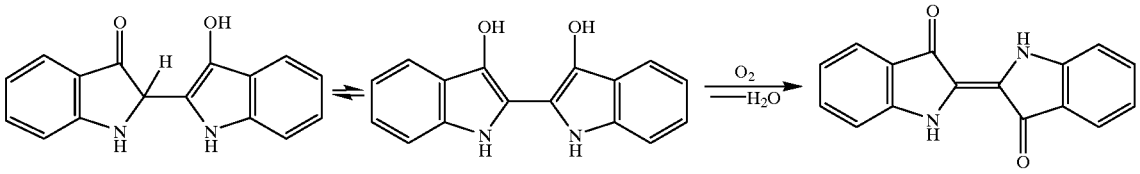

leuco-indigo indigo

Using the process according to the invention, the operations usually carried out to dye thread indigo blue are modified by adding supplementary operations both at the bath stages and at the stage of oxidation and preliminary mercerization to facilitate the absorbency and impregnation capacity of the thread.

During the course of the oxidation process, the first step is very rapid exposures to the air at the start of the process in the first dyeing baths, and then after each bath the duration of exposure is progressively increased to promote penetration of the indigo into the thread.

The thread is then sprayed under defined temperature and pressure conditions before being washed and then mercerized again.

The second phase of the process consists in forming an insulation around the new dyed thread to render it insensitive to washing, and it is then ready for use. In order to do this, the thread must firstly be rendered neutral by passing it successively through acid baths.

The thread is then fully dried before being immersed in a bath which will finally fix the indigo and will impart the desired properties. The thread obtained by the known processes of the art is formed by a white, i.e. non-dyed, central core and by an external portion impregnated with the indigo dye. As a result of the process according to the invention, the thread will be formed by a much thinner white central core and the indigo will penetrate much more deeply into the external portion so that it will be dyed to a much greater depth. Ideally, the thread will be dyed right through by the indigo.

BRIEF DESCRIPTION OF THE SEVERAL VIEWS OF THE DRAWINGS

For better understanding of the invention reference is made to the accompanying figures wherein.

Corresponding reference numerals will be used throughout the several figures of the drawings.

DETAILED DESCRIPTION OF THE INVENTION

Figure 1:
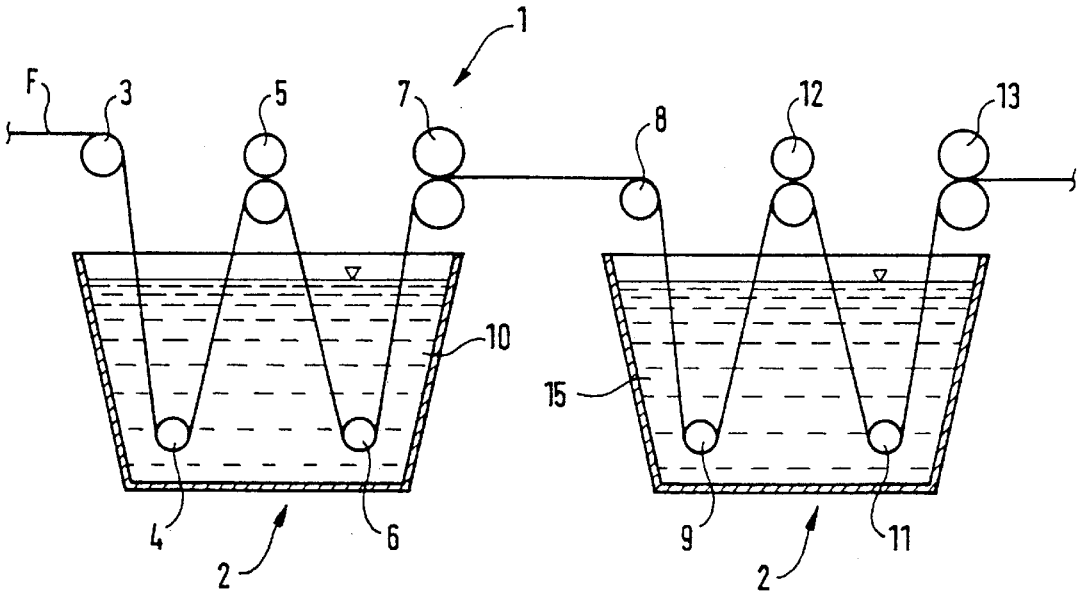
FIG. 1 shows a schematic view of the arrangement for prewashing used during the process according to the invention.

The process according to the invention will now be described by references to FIGS. 1 to 5 in succession. In this process, a prewashing step is firstly undertaken, wherein the thread F coming from an output roller on which it is rolled is passed through a prewashing arrangement 1 comprising two or more tanks 2 containing a prewash solution 10, 15. The thread is guided by rollers 3 and 4 into the first tank 2 containing the prewash solution, and then upon leaving this solution it passes through two pressing rollers 5 to remove the excess prewash solution, and then, guided by roller 6, is plunged again into the prewash solution. Upon leaving this bath, the thread passes between pressing rollers 7. Then, guided by guide rollers 8 and 9, the thread is plunged into the prewash solution 15 located in the second tank 2. The thread will be moved around in the second tank following an identical path to that in the first tank passing successively between the two pressing rollers 12, under the guide roller 11 and then between pressing rollers 13.

The prewash solution contains an inhibitor product such as FINBIL AS (a product of the Bozzetto company) (trade name) which is a derivative of fatty alkyl phosphate ester. It is used in the aqueous solution in a concentration of 5 to 8 gr/liter. This prewash bath is used to impregnate the thread in order to promote the subsequent penetration of the indigo.

Figure 2:
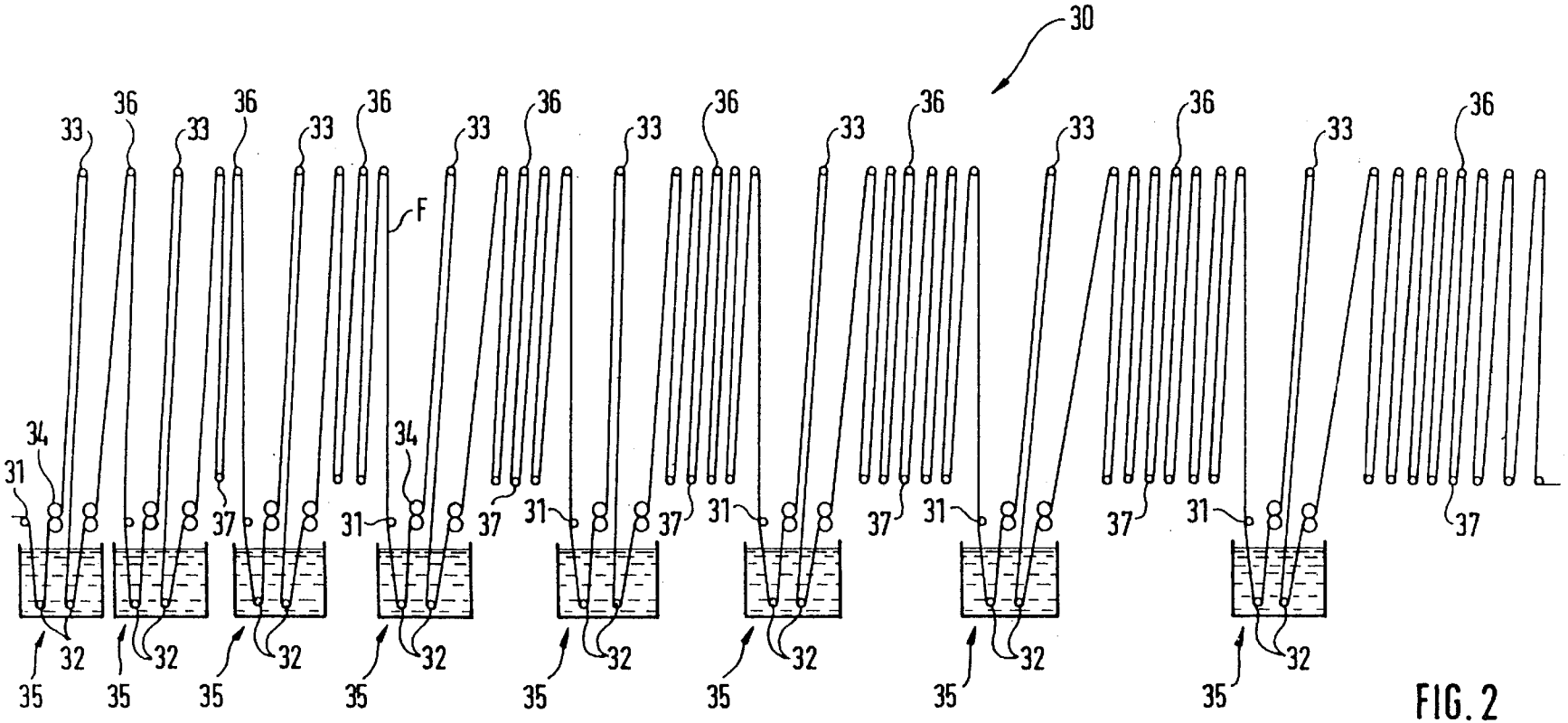
FIG. 2 shows a schematic view of the arrangement for dyeing with indigo used during the process according to the invention.

After this prewashing step, the actual dyeing of the thread is performed using the dyeing arrangement 30 shown in FIG. 2.

The dyeing arrangement 30 comprises a series of eight tanks 35 containing a solution of reduced indigo. The thread F coming from the prewash arrangement is guided by the guide roller 31 into the dyeing solution located in the first tank 35, is turned around roller 32 and leaves the bath, passing between the first pressing rollers 34 in the first tank, is passed around roller 33 and is returned to the dyeing solution in the first tank, is passed around the second roller 32 of the first tank to then leave the bath, is passed between the second set of pressing rollers 34 of the first tank. The thread is then passed around roller 36. On the route between the second set of pressing rollers 34 and the roller 36, the impregnated thread is oxidized and the indigo dyeing the thread is set. After it has been passed around roller 36, the thread is passed into the dyeing solution in the second tank, where it follows the same path as in the first tank via rollers 31, 32 and 34 of this second tank. Upon leaving the second tank, the thread is not passed around one roller 36, as occurred upon leaving the first tank, but around two rollers 36 and two rollers 37 so that the passage through the air upon leaving the second tank is twice as long as that upon leaving the first tank, and oxidation will thus be twice the amount. After it has been passed around the two rollers 36 and 37, the thread is passed into the third tank, and so on until it reaches the eighth tank, the thread being passed around rollers 36 upon leaving each tank. It must be noted, as shown in FIG. 2, that there are three rollers 36 between the third and fourth tanks, four rollers 36 between the fourth and fifth tanks, and so on until the eighth tank, where there are eight rollers 36 upon exit. As a result, the time of exposure to the air is progressively increased when passing from the first tank to the eighth in such a way that if the value x is given to the oxidation between the first and second tanks, the successive result will be:

Between the 1st and 2nd tanks the oxidation value=x

Between the 2nd and 3rd tanks the oxidation value=2x

Between the 3rd and 4th tanks the oxidation value=3x

Between the 4th and 5th tanks the oxidation value=4x

Between the 5th and 6th tanks the oxidation value=5x

Between the 6th and 7th tanks the oxidation value=6x

Between the 7th and 8th tanks the oxidation value=7x

After the 8th tank the oxidation value=8x;

The dyeing baths contain a solution of reduced indigo containing 3 to 5% of powdered indigo, a corresponding quantity of sodium hydrosulphite amounting to ⅔ of the quantity of indigo and a corresponding quantity of caustic soda 36 Baumé amounting to double the quantity of indigo.

The threads pass through the baths at a speed of 20 to 60 m/minute, depending on the type and quality of the thread.

The example shown in FIG. 2 comprises eight tanks, but it goes without saying that the operation may be repeated two, three or more times as desired using two, three or more sets of eight tanks to thus obtain an ever increasing penetration of the indigo into the thread.

An intense and dark indigo color in the thread is achieved as a result of this dyeing process.

Figure 3:
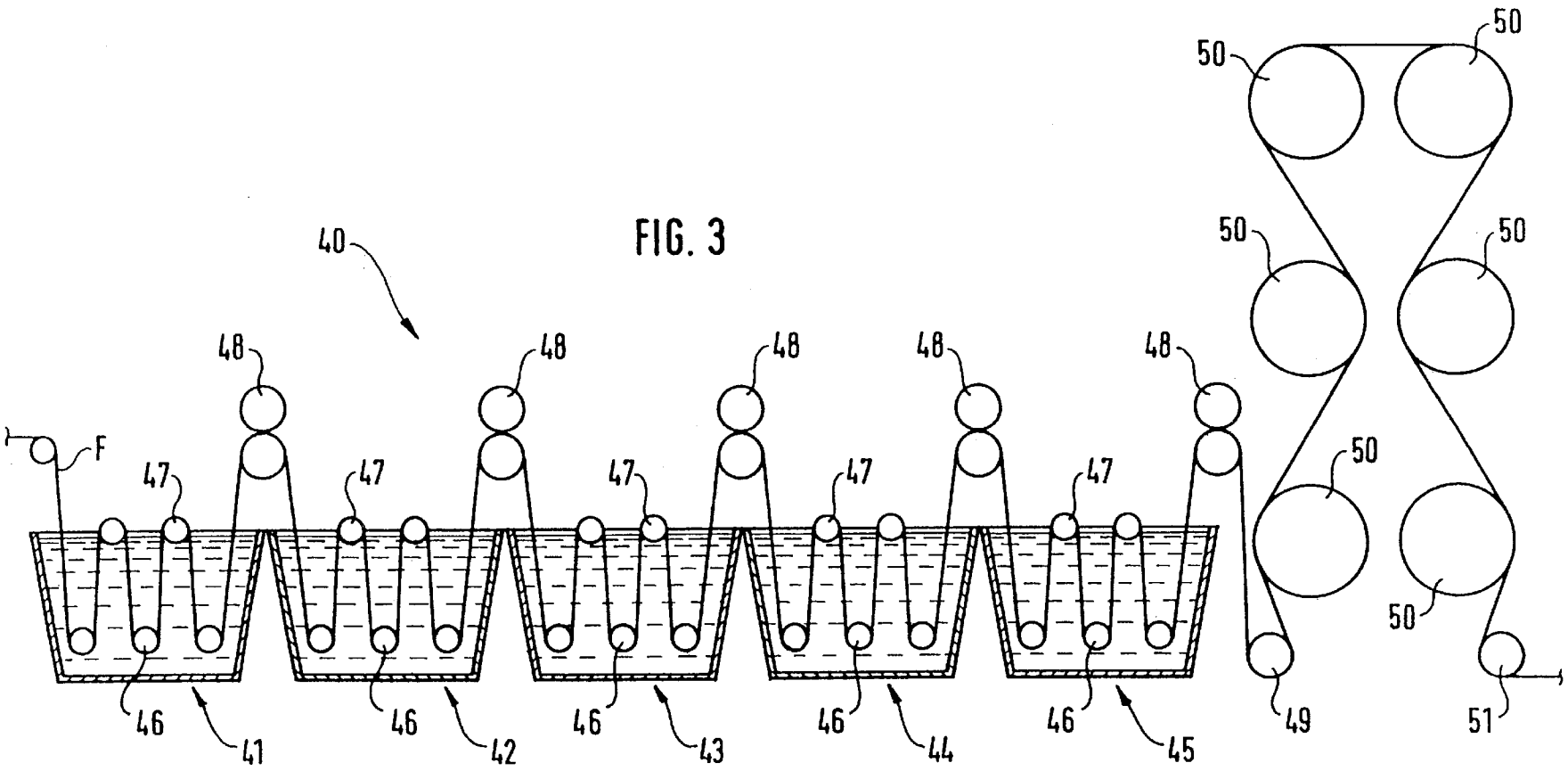
FIG. 3 shows a schematic view of the arrangement for washing and initial drying used during the process according to the invention.

When the thread has been dyed, the next procedure is its washing and initial drying using the arrangement 40 described in FIG. 3. The thread is passed successively into tanks 41 to 45, being guided by means of rollers 46, 47 and 48. The tank 41 contains water and an acetic acid ($CH_3$—COOH) is added to 50% to tanks 42,43 and 44 so that tank 42 contains a proportion of 20 cc/l, tank 43 contains 10 cc/l and tank 44 contains 5 cc/l. Tank 45 contains water again, the final pH being between 6 and 7, preferably 6.7.

Upon leaving tank 45, the thread proceeds to the pre-dying stage by passing around rollers 50, as may be seen in FIG. 3.

Figure 4:
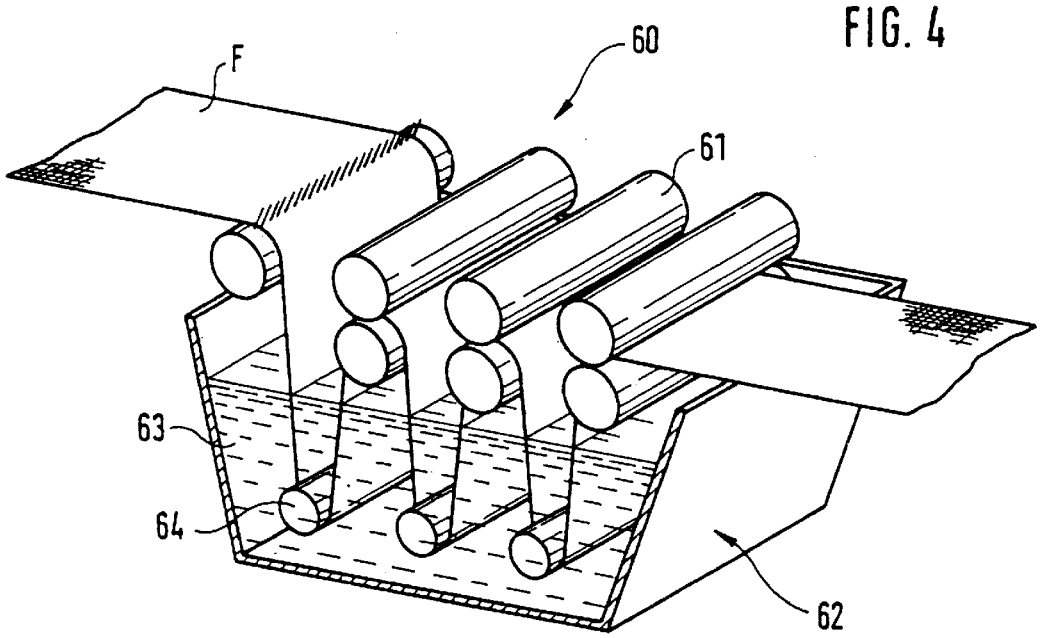
FIG. 4 shows a schematic view of the sizing arrangement used during the process according to the invention.

After the thread has been washed and pre-dried, the next procedure is the sizing of the indigo dye onto the thread to increase resistance to washing and rubbing of the fabrics which will be ultimately made up, wherein the thread is passed through the sizing arrangement 60 described in FIG. 4. The thread is passed into a tank 62 containing a mixture of resins 63 and is guided through the tank by means of guide rollers 64 and pressing rollers 61.

The composition of the mixture of resins is as follows:

10 to 50 g/l of quaternary salts of polyalkylamine;

10 to 50 g/l of fluorocarbon resin;

10 to 200 g/l of acrylic resin;

1 to 20 g/l of autocatalysed polysiloxane; and 10 to 200 g/l of polyurethane resin During this sizing, a transparent film forms on the fibers of the thread which fixes the indigo on the thread and thus increases its resistance to washing.

Figure 5:
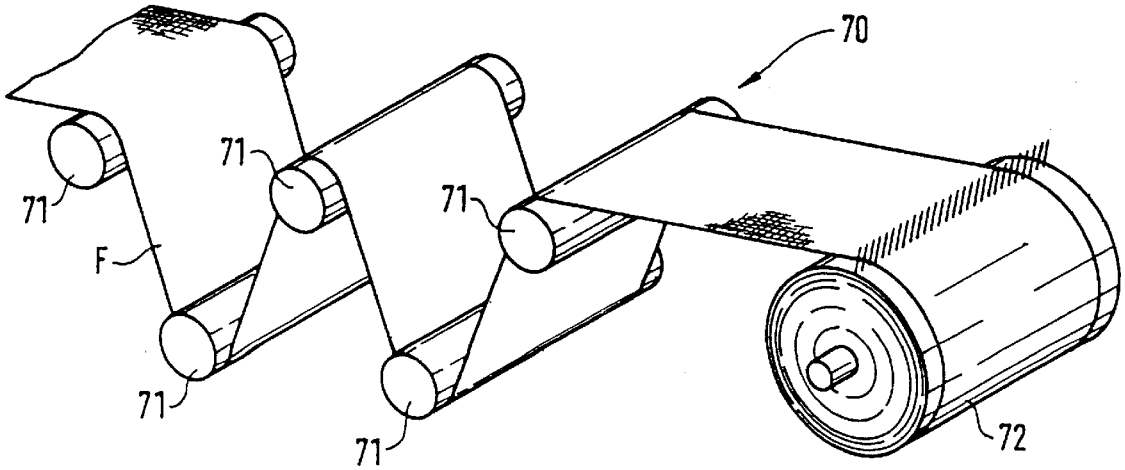
FIG. 5 shows a schematic view of the arrangement for drying and forming the warp thread according to the invention.

After this sizing stage, the next procedure is drying of the thread by means of the arrangement 70 shown in FIG. 5, wherein the thread is passed around rollers 71. This drying operation is conducted at a temperature of between 150° and 180° C.

Finally, the warp thread is rolled around roller 72.

The process according to the invention may be carried out with various types of threads, e.g. cotton, cotton and nylon, cotton and polyester etc.

The process and the arrangement for conducting the process are the preferred embodiments, and it must be understood that modifications may be made, and these modifications must be understood to be likewise covered within the limits of the following claims.

We claim:

1. A Process for dyeing a thread with indigo, characterized in that the process comprises the following steps:

a. prewashing the thread (F) by passing it through a prewash arrangement (1) comprising two or more prewash tanks (2) containing a prewash solution (10, 15);

b. then dyeing the thread by passing it through a dyeing arrangement (30) comprising a series of dyeing tanks (35) each containing a solution of reduced indigo, and when passing from one dyeing tank (35) to another the thread is subjected to oxidation by exposure to the air transforming the reduced indigo into indigo, which then dyes the thread by impregnation, the oxidation by exposure to the air being achieved in such a way that when passing from the first dyeing tank (35) to the eighth in succession, if the value x is given to the oxidation between the first and second dyeing tanks, the successive result will be:
Between the 1st and 2nd tanks the oxidation value=x
Between the 2nd and 3rd tanks the oxidation value=2x
Between the 3rd and 4th tanks the oxidation value=3x
Between the 4th and 5th tanks the oxidation value=4x
Between the 5th and 6th tanks the oxidation value=5x
Between the 6th and 7th tanks the oxidation value=6x
Between the 7th and 8th tanks the oxidation value=7x
After the 8th tank the oxidation value=8x;

c. washing and initial drying the thread by passing it through a washing and initial drying arrangement (40) comprising a series of washing tanks (41, 42, 43, 44 and 45) including a first washing tank, at least one middle washing tank, and a last washing tank; the first washing tank (41) containing water, the at least one middle washing tank (42, 43 and 44) containing acetic acid, and the last washing tank (45) containing water such that the pH in the last tank will be between 6 and 7, and upon exit from the last washing tank (45), the thread is pre-dried by passing it between drying rollers (50);

d. sizing the indigo dye on the thread by passing it through a sizing arrangement (60) comprising a sizing tank (62) containing a mixture of resins to form a transparent film on the fibers of the thread;

e. drying the thread by passing it through a drying arrangement (70) comprising drying rollers (71); and f. collecting the thread by rolling it on a drum (72).

2. The process according to claim 1, characterized in that the prewash solution contains a derivative of fatty alkyl phosphate ester.

3. The process according to claim 1, characterized in that the dyeing tanks (35) contain a solution of reduced indigo containing 3 to 5% of powdered indigo, a corresponding quantity of sodium hydrosulphite amounting to ⅔ of the quantity of indigo and a corresponding quantity of caustic soda 36 Baumé amounting to double the quantity of indigo.

4. The process according to claim 1, characterized in that there are three middle washing tanks; the acetic acid solution in a first middle washing tank (42) is obtained by adding 50% acetic acid to the tank (42) in a quantity of 20 cc/l; the acetic acid solution in a second middle washing tank (43) is obtained by adding 50% acetic acid to the tank (43) in a quantity of 10 cc/l; and the acetic acid solution in a third middle washing tank (44) is obtained by adding 50% acetic acid to the tank (44) in a quantity of 5 cc/l.

5. Process according to claim 1, characterized in that the composition of the mixture of resins during the course of the sizing step comprises a mixture of:

10 to 50 g/l of quaternary salts of polyalkylamine; 10 to 50 g/l of fluorocarbon resin;

10 to 200 g/l of acrylic resin;

1 to 20 g/l of autocatalysed polysiloxane; and 10 to 200 g/l of polyurethane resin.

6. The process according to claim 1, characterized in that dyeing step may be repeated several times using 8x dyeing tanks (35), where x is an integer and has a value equal to or greater than 1.

7. Process according to claim 1, characterized in that the threads pass through the dyeing baths at a speed of 20 to 60 m/minute.

8. An arrangement for conducting a dyeing process comprising:

a) a prewash arrangement (1);

b) a dyeing arrangement (30); the dyeing arrangement including two or more dyeing tanks each containing a solution of reduced indigo and one or more rollers after each dyeing tank; said rollers defining a path of travel after each tank, the path of travel after each tank being of a longer duration than the path of travel after the preceding tank to increase the time of oxidation of the reduced indigo after each dyeing tank;

c) a washing and initial drying arrangement (40);

d) a sizing arrangement (60); and e) a drying arrangement (70).

9. The arrangement according to claim 8, characterized in that the prewash arrangement comprises: two or more prewash tanks (2) containing a prewash solution (10, 15), a first guide roller (3) to direct the thread into the prewash solution (10), a second guide roller (4) to direct the thread between two pressing rollers (5) which guides the thread towards a third guide roller (6), two pressing rollers (7) to remove the excess of liquid, a fourth guide roller (8) directing the thread into the washing liquid (15) of a second washing tank (2), a fifth guide roller (9) directing the thread towards two pressing rollers (12), a sixth guide roller (11) directing the thread once again into the prewash liquid of the second prewash tank (15) and two pressing rollers (13) to initially drying the thread upon exit from the second prewash tank (2).

10. The arrangement according to claim 8, characterized in that the sizing arrangement (60) comprises a sizing tank (62) containing a mixture of resins.

11. The arrangement according to claim 9, characterized in that the prewash solution contains a derivative of fatty alkyl phosphate ester.

12. An arrangement for conducting a dyeing process comprising:

a) a prewash arrangement (1);

b) a dyeing arrangement (30);

c) a washing and initial drying arrangement (40);

d) a sizing arrangement (60); and e) a drying arrangement (70);

wherein the dyeing arrangement (30) comprises a series of eight dyeing tanks (35) containing a bath of reduced indigo, a series of rollers (31, 32, 33, 34, 36 and 37) associated with each dyeing tank, the rollers (36) being disposed between each dyeing tank (35) in such a manner that there is one roller (36) between the first and second dyeing tanks (35), two rollers (36) between the second and third dyeing tanks, three rollers (36) between the third and fourth dyeing tanks (35) and so on and so on until the eighth dyeing tank, where there are eight rollers (36), thus enabling the time of exposure to the open air to be progressively increased so that the thread is oxidized in such a way that if the value x is given to the oxidation between the first dyeing tank (35) and the second dyeing tank, the successive result will be:

Between the 1st and 2nd tanks the oxidation value=x
Between the 2nd and 3rd tanks the oxidation value=2x
Between the 3rd and 4th tanks the oxidation value=3x
Between the 4th and 5th tanks the oxidation value=4x
Between the 5th and 6th tanks the oxidation value=5x
Between the 6th and 7th tanks the oxidation value=6x
Between the 7th and 8th tanks the oxidation value=7x
After the 8th tank the oxidation value=8x.

13. The arrangement according to claim 12, characterized in that the reduced indigo bath in dyeing tanks (35) contains 3 to 5% of powdered indigo, a corresponding quantity of sodium hydrosulphite amounting to ⅔ of the quantity of indigo and a corresponding quantity of caustic soda 36 Baumé amounting to double the quantity of indigo.

14. The arrangement according to claim 12, characterized in that the dyeing arrangement may include two or more sets of eight dyeing tanks.

15. An arrangement for conducting a dyeing process comprising:

a) a prewash arrangement (1);

b) a dyeing arrangement (30);

c) a washing and initial drying arrangement (40);

d) a sizing arrangement (60); and e) a drying arrangement (70);

wherein the washing and initial drying arrangement (40) comprises a series of washing tanks (41, 42, 43, 44 and 45) including a first washing tank, a middle washing tank, and a last washing tank, and rollers (46, 47 and 48) associated with each washing tank; the first washing tank (41) containing water, the middle washing tank (42, 43 and 44) containing acetic acid, and the last washing tank (45) containing water such that the pH in the last washing tank will be between 6 and 7, and upon exit from the last washing tank (45) a series of rollers (50) is provided for drying the thread.

16. The arrangement according to claim 15, characterized there are three middle washing tanks; and in that in the acetic acid solution in the first middle washing tank (42) is obtained by adding 50% acetic acid to the tank (42) in a quantity of 20 cc/l; the acetic acid solution in the second middle washing tank (43) is obtained by adding 50% acetic acid to the tank (43) in a quantity of 10 cc/l, and the acetic acid solution in the third middle washing tank (44) is obtained by adding 50% acetic acid to the tank (44) in a quantity of 5 cc/l.

17. An arrangement for conducting a dyeing process comprising:

a) a prewash arrangement (1);

b) a dyeing arrangement (30);

c) a washing and initial drying arrangement (40);

d) a sizing arrangement (60); and e) a drying arrangement (70);

wherein the sizing arrangement (60) comprises a sizing tank (62) containing a mixture of resins, the composition of the mixture of resins used in the sizing arrangement comprises a mixture of:

10 to 50 g/l of quaternary salts of polyalkylamine;

10 to 50 g/l of fluorocarbon resin;

10 to 200 g/l of acrylic resin;

1 to 20 g/l of autocatalysed polysiloxane; and 10 to 200 g/l of polyurethane resin.

* * * * *

UNITED STATES PATENT AND TRADEMARK OFFICE

CERTIFICATE OF CORRECTION

PATENT NO. : 6,123,741
DATED : September 26, 2000
INVENTOR(S) : Girbaud et al.

It is certified that error appears in the above-identified patent and that said Letters Patent is hereby corrected as shown below:

Title page,
Item [57], ABSTRACT,
Line 19, in "b." after "second tanks, the result will be:" and before "After the 8th tank oxidation value =8x" insert the following:

-- Between the 1st and 2nd tanks the oxidation value = x
Between the 2nd and 3rd tanks the oxidation value = 2x
Between the 3rd and 4th tanks the oxidation value = 3x
Between the 4th and 5th tanks the oxidation value = 4x
Between the 5th and 6th tanks the oxidation value = 5x
Between the 6th and 7th tanks the oxidation value = 6x
Between the 7th and 8th tanks the oxidation value = 7x --

In "c." after "drying arrangement (40)" insert the following:
-- comprising a series of tanks (41, 42, 43, 44 and 45), the first tank (41) containing water, tanks (42, 43, and 44) containing acetic acid and tank (45) containing water such that the pH in the last tank will be between 6 and 7, and upon exit from the tank (45), the thread is pre-dried by passing it between rollers (50) --;

Column 3,
Line 42, replace "new" with -- now --

Column 6,
Lines 42, 43, 44, 45, 46, 47, 48 and 49, before the words "tanks" and "tank" insert the word -- dyeing --

Column 8,
Lines 24, 25, 26, 27, 28, 29, 30 and 31, before the words "tanks" and "tank" insert the word -- dyeing --

Signed and Sealed this

Tenth Day of December, 2002

JAMES E. ROGAN
*Director of the United States Patent and Trademark Office*